United States Patent [19]

Vazquez et al.

[11] 4,434,847

[45] Mar. 6, 1984

[54] FLOW CONTROLLING APPARATUS

[75] Inventors: Gonzalo Vazquez; Neil H. Akkerman, both of Houston, Tex.

[73] Assignee: AVA International Corporation, Houston, Tex.

[21] Appl. No.: 358,127

[22] Filed: Mar. 17, 1982

[51] Int. Cl.[3] ..... E21B 23/03; E21B 34.14

[52] U.S. Cl. ..... 166/117.5; 166/332; 166/72; 166/313; 166/321; 166/375

[58] Field of Search ..... 166/117.5, 319–322, 166/324, 332, 334, 189, 72, 73, 374, 375, 183, 184, 131, 313

[56] References Cited

U.S. PATENT DOCUMENTS

| | | | |
|---|---|---|---|
| 3,098,526 | 7/1963 | Heron | 166/183 |
| 3,799,258 | 3/1974 | Tausch | 166/72 |
| 3,958,633 | 5/1976 | Britch et al. | 166/117.5 |
| 4,325,431 | 4/1982 | Akkerman | 166/117.5 |

*Primary Examiner*—William F. Pate, III
*Assistant Examiner*—Hoang C. Dang
*Attorney, Agent, or Firm*—Vaden, Eickenroht, Thompson, Bednar & Jamison

[57] ABSTRACT

There is disclosed apparatus for controlling flow through both a tubing string suspended within a well bore and the space within the well bore about the tubing string. The illustrated embodiment of the apparatus comprises a body made up of a pair of mandrels and having a first bore therethrough adapted to be connected as part of the tubing string, whereby it may be lowered with the string into the well bore, a second bore therethrough parallel to the first bore for connection at its upper and lower ends with the space about the tubing string, and closure members mounted on the body for opening and closing the first and second bores. The body has first and second pockets therein each having one end opening to the first bore, a first tool is adapted to be run on a wire line through the tubing string and first bore into and out of the first pocket, and a second tool is adapted to be run on a wire line through the tubing string and first bore into and out of the second pocket. More particularly, a fluid responsive mechanism is provided within each of the first and second tools for moving the first and second closure members, respectively, from normally closed to opened positions.

25 Claims, 8 Drawing Figures

Fig. 2A
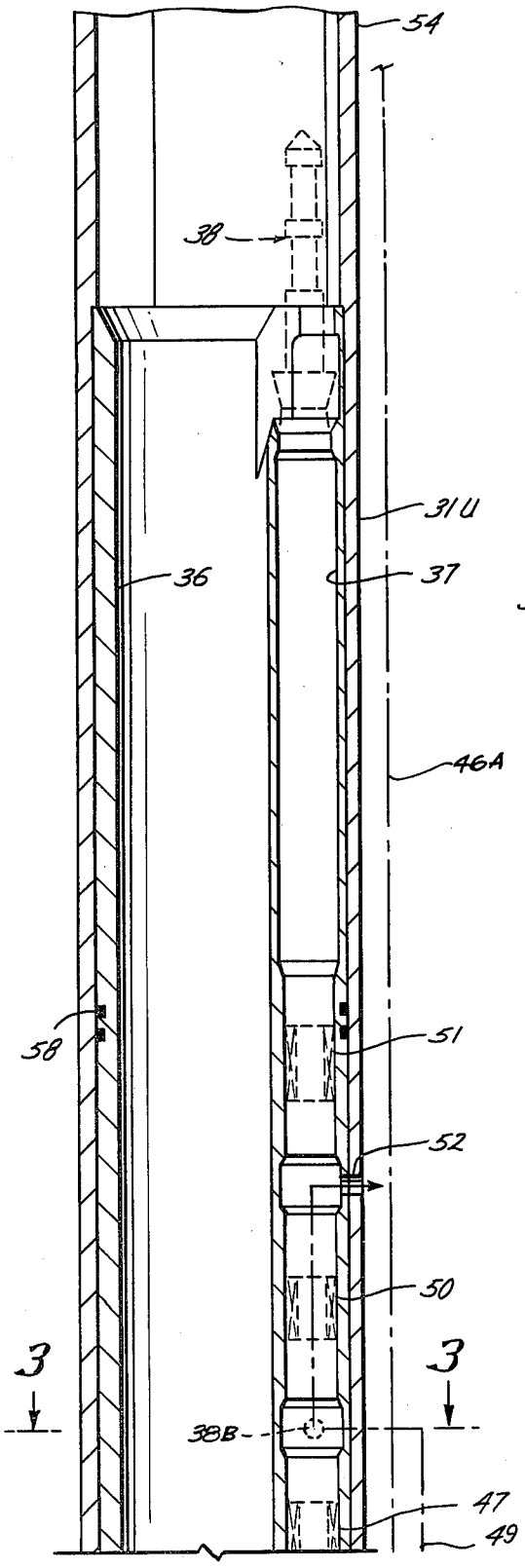
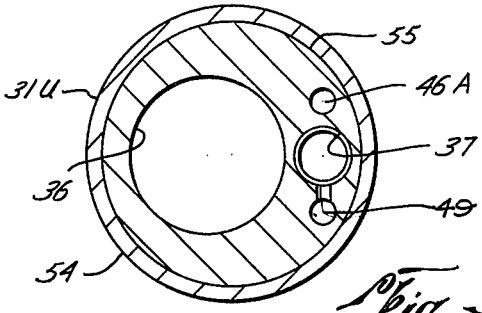
Fig. 3
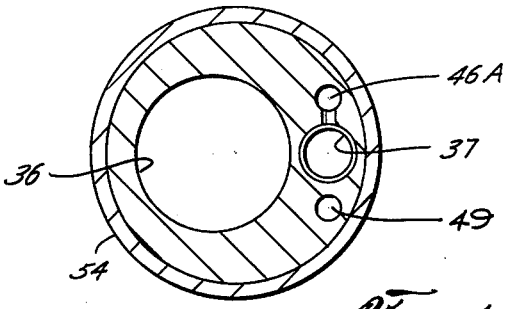
Fig. 4
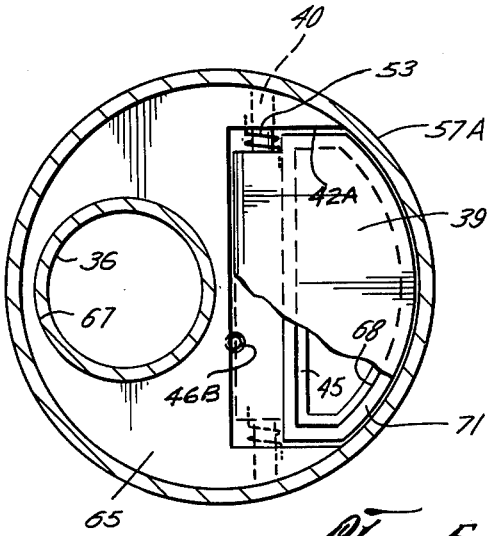
Fig. 5

36
46A
38A
48
38
49
4
4
59
56
63
57
69
69A
44
41
60
45
57A
45A
46C
65
66
68
70
36
46B
67
71
71
40
64
53
39
42A
5
5
42
57B
60
61
62
57B
36
41
73
33
34
72
74
35
75

FLOW CONTROLLING APPARATUS

This invention relates generally to apparatus for controlling flow within a well bore; and, more particularly, to improved apparatus which is adapted to control flow through both a tubing string suspended within the well bore, and the space within the well bore about the tubing string.

It may be necessary to produce oil and gas from high potential wells through the space about the tubing string as well as through the tubing string itself. This production may be from the same zone or different zones within the well bore. If production through the space about the tubing requires gas lift, the lifting gas may be injected into the annulus through the tubing string. Even when production requires no artificial lift, the tubing string may be used to measure flowing pressures, for wire line work or to permit the well to be killed.

It is common practice to control the flow of well fluid within a tubing string by means of a subsurface valve which is normally held open, but which is adapted to close automatically in response to an abnormality. Thus, in a typical subsurface safety valve, the closure member, which may be a flapper or a ball having a through port, is urged toward closed position by a spring or other biasing means. Under normal circumstances, the closure member is held open by fluid responsive means to which control fluid is supplied from a suitable source at the surface level through a conduit extending downwardly along the tubing. In the event the tubing and the control fluid conduit are sheared above the subsurface valve, or some other abnormality occurs, the control fluid is exhausted from the fluid responsive means so as to permit the spring to automatically move the closure member to closed position. Preferably, subsurface safety valves are of the tubing mounted type because, when open, they do not obstruct the bore through the tubing. However, since the closure member is mounted in the tubing string, the parts of the fluid responsive means for operating it, and particularly their dynamic seals, may not be retrieved for replacement or repair without pulling the tubing string. On the other hand, although wire line retrievable valves of this type enable the closure member and its operating parts to be retrieved, they must be removed to permit certain wire line operations beneath the valve.

Copending patent application, Ser. No. 168,435, filed July 10, 1980, entitled "FLOW CONTROLLING APPARATUS", and assigned to the assignee of the present application, discloses a subsurface safety valve wherein the closure member is moved to and held in open position by means of a control fluid responsive plunger contained within a tool which is removably landed within a pocket to one side of a through bore. This subsurface safety valve thus has the advantages of both the tubing mounted and wire line retrievable type, without the disadvantages of either, in that it provides a full opening therethrough while at the same time permitting at least some and preferably all of the parts for operating the closure member to be retrieved with the wire line tool for replacement and repair without pulling the entire tubing string.

Page 755 of the 1980-81 *Composite Catalog* discloses apparatus for controlling flow within the space about a tubing string as well as through the tubing wherein flow through ports in the tubing string just above the packer is controlled by means of a sleeve valve installed within the tubing string. However, control fluid for operating the sleeve is conducted downwardly through the tubing string, so that well fluids may not be produced simultaneously through both the tubing string and the space about it. It has also been proposed to simultaneously produce well fluids through a tubing string having a safety valve for controlling flow through a first bore connecting with the tubing string, and a second bore connecting with the space about the tubing and also having a safety valve installed therein. However, the safety valve within the second bore cannot be retrieved without pulling a packer which closes off the annulus beneath the valves. Also, the area through which well fluids may flow is restricted by the bore through the packer.

The primary object of this invention is to provide apparatus of the type described for controlling flow within the space about the tubing string, and which, as in the case of the above-described tubing safety valve, permits at least some and preferably all of the operating parts thereof to be retrieved for repair or replacement.

This and other objects are accomplished, in accordance with the illustrated embodiment of the invention, by means of apparatus which comprises body means having a first bore therethrough which is adapted to be connected as part of the well tubing string, whereby it may be lowered with the string into the well bore, a second bore therethrough parallel to the first bore for connection at its upper and lower ends with the space within the well bore about the tubing string, and closure members mounted on the body means for movement between positions opening and closing the first and second bores. More particularly, the body means has first and second pockets therein each having one end opening to the first bore, a first tool is adapted to be run on a wire line through the tubing string and first bore into and out of the first pocket, and a second tool is adapted to be run therethrough into and out of the second pocket. In the illustrated embodiment for which this invention is particularly well suited, each closure member is urged to closed position by spring means, and means including means responsive to the supply of control fluid thereto is provided within the tools for moving each of the closure members to open position, whereby in the event of an abnormality, and the exhaust of control fluid therefrom, the closure member automatically returns to closed position.

More particularly, the apparatus includes, in addition to a first mandrel in which the tubing safety valve is mounted, a second mandrel which has a first bore adapted to be connected to the first mandrel, so that both mandrels may be installed within the well bore one above the other, as well as a second bore therethrough to connect at its upper and lower ends with the space about the tubing string. A closure member is mounted on the second mandrel for opening and closing the second bore and thus controlling flow within the space about the tubing string, and the second mandrel has a pocket therein having one end opening to the first bore to receive another tool adapted to be run on a wire line through such tubing and first bore into and out of such pocket. More particularly, the closure member is also urged by spring means to its closed position, and means including fluid responsive means within the tool is provided for moving the closure member into its open position and holding it in such position. Consequently, and as in the case of the valve for controlling flow through the space about the tubing string, the second bore is relatively unobstructed and parts of the fluid responsive means may be retrieved for replacement or repair.

In the preferred and illustrated embodiment of the invention, the first bore of the second mandrel on which the closure member for controlling flow within the space is mounted is of cylindrical shape having an axis eccentric to the outer diameter of the mandrel, and the outer side of the second bore thereof is curved about an axis generally coaxial with its outer diameter mandrel. More particularly, the closure member is a flapper of a shape corresponding to that of the second bore and pivotally mounted on the mandrel for swinging between opened and closed positions, whereby there is a minimum obstruction to flow through the space within the well bore about the tubing string—i.e., the flow path through the bore is of an area which at least approaches that of the space itself.

In the drawings, wherein like reference characters are used throughout to designate like parts:

Figure 1A:
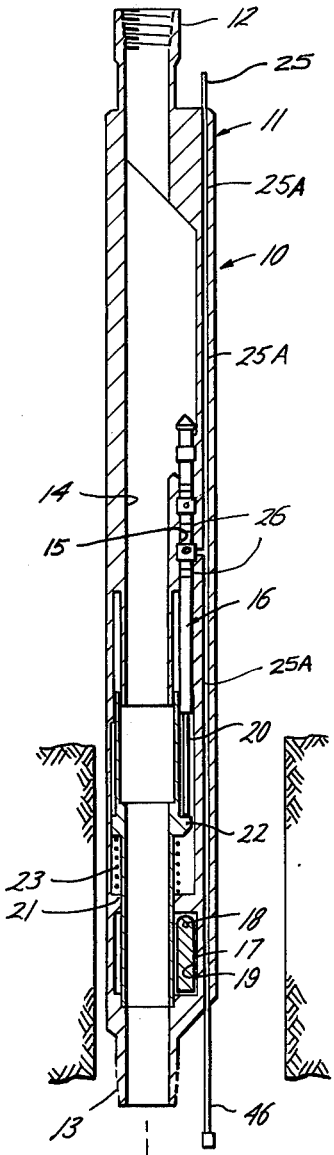
FIG. 1A is a vertical sectional view of the first mandrel in the apparatus which includes the subsurface valve for controlling flow through a tubing string from which the mandrel is suspended within the well bore, the closure member of the valve being shown in its open position during normal operation.
Figure 1B:
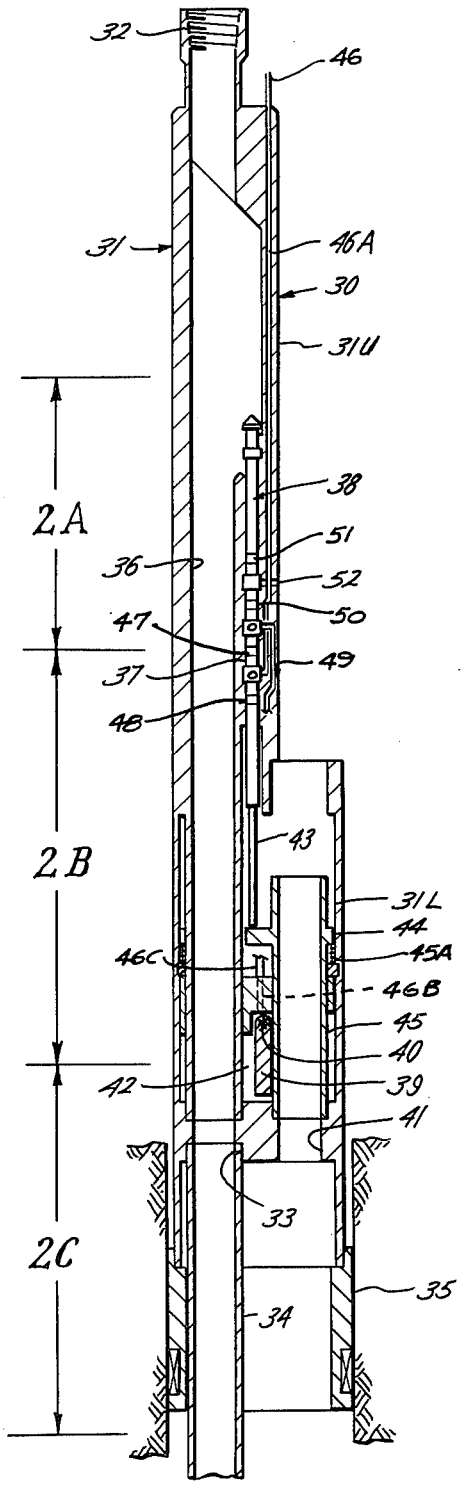
FIG. 1B is a vertical sectional view of the second mandrel of such apparatus which is suspended beneath the first mandrel and which includes the subsurface safety valve for controlling flow through the space within the well bore about the tubing string, the closure member of such valve being shown in its open position during normal operation.
Figures 2B, 2C:
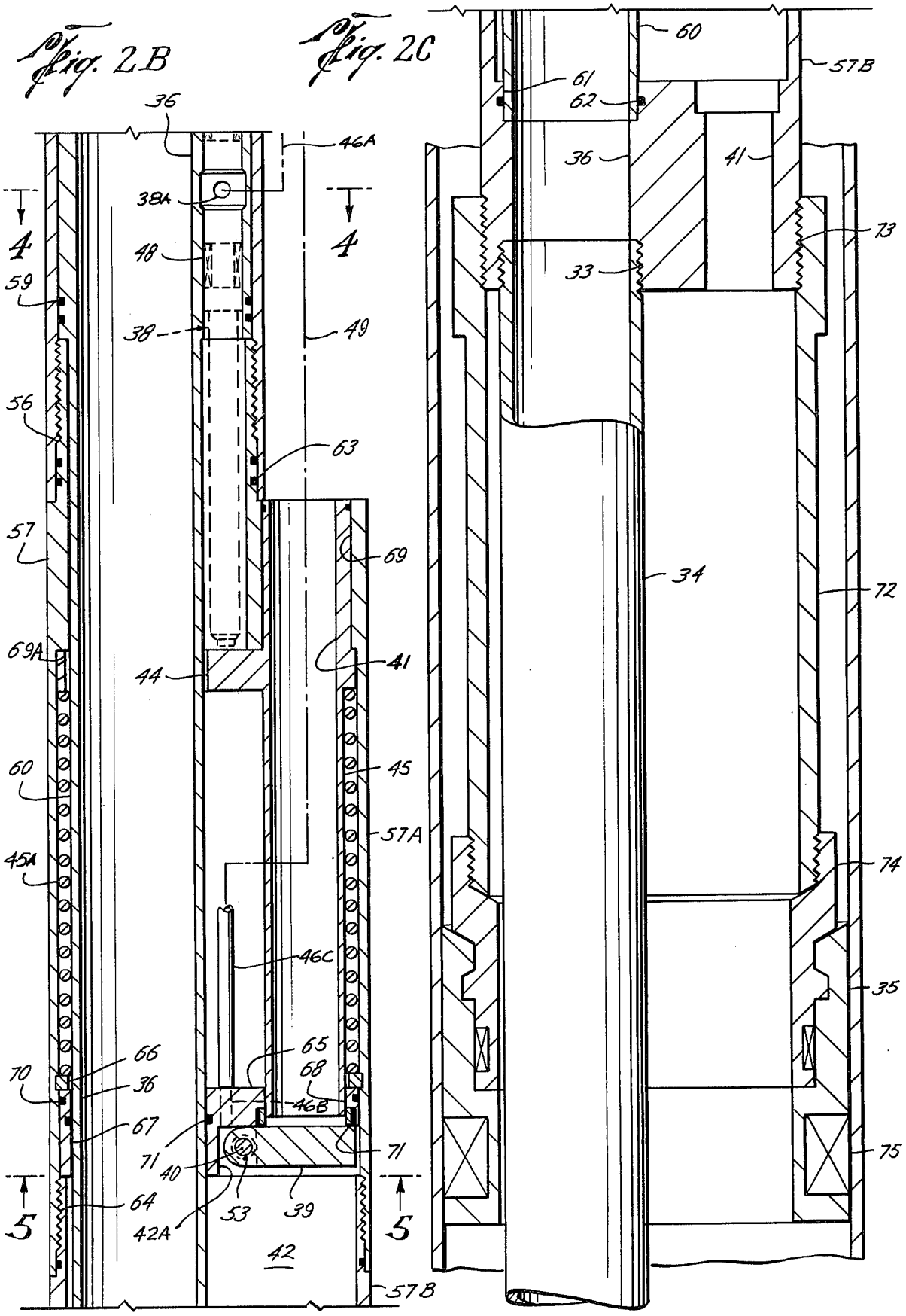

FIGS. 2A, 2B and 2C are enlarged vertical sectional views of portions of the second or lower mandrel shown in FIG. 1B, as indicated by corresponding numerals to the left thereof, with the wire line tool for use in operating the closure member thereof being shown in broken lines and its plunger being withdrawn, in response to the exhaustion of control fluid from the fluid responsive means thereof, in order to permit the closure member to be moved to its closed position; and FIGS. 3, 4 and 5 are cross-sectional views of the lower mandrel, as seen along broken lines 3—3, 4—4 and 5—5 of FIGS. 2A and 2B.

With reference now to the details of the above-described drawings, the subsurface safety valve shown in FIG. 1, and designated in its entirety by reference character 10, is substantially identical to that shown and described in the aforementioned patent application, Ser. No. 186,435. Thus, as shown in FIG. 1, the valve comprises a mandrel 11 which is cylindrical in cross section intermediate upper and lower tubular ends 12 and 13 adapted to be connected to the tubing string. More particularly, a bore 14 through the mandrel forms a continuation of openings through the end connections whose axis is eccentric with respect to the axis of the intermediate cylindrical portion thereof. A pocket 15 is formed in a thickened wall portion of the mandrel to one side of the bore 14 and has an open end to receive a well tool 16 therein, which, as previously mentioned, may be run on a wire line through the tubing string and the bore 14 into and out of the pocket 15. The bore 14 is adapted to be opened and closed below the upper end of the pocket by means of a flapper 17 pivotally connected to the mandrel by means of a pin 18, and the flapper is urged by a spring (not shown) into closed position across the bore and within a recess 19 in the thickened wall portion of the body beneath the pocket.

As fully described in the aforementioned patent application, a plunger 20 is mounted for reciprocation within tool 16, so that with the tool landed in the pocket 15, as shown in FIG. 1, its lower end may be extended to engage and lower a flow tube 21 reciprocable within the mandrel and forming a continuation of the bore 14 therethrough. When so lowered, the flow tube pushes against the upper side of the flapper 17 to swing it to its open position and hold it in such position as the flow tube moves further downwardly into engagement with a stop shoulder in the mandrel. For this purpose, the flow tube has a collar 22 thereabout which is beneath the lower end of the plunger, and thus in a position to be engaged thereby. The tube is urged upwardly by means of a coil spring 23 acting between the lower side of the collar and a shoulder about a reduced diameter portion of the mandrel, so that, when the plunger is retracted, the flow tube is raised to permit the flapper to close against a seat about the lower side of the reduced diameter portion.

As also fully shown and described in the aforementioned copending application, plunger 20 is adapted to be extended by means of a piston at its upper end which is sealably slidable within a pressure chamber within tool 16 to which control fluid may be supplied. More particularly, this control fluid is supplied from a source at the wellhead through a control line 25 which connects with a hole 25A in the mandrel leading to the pocket intermediate seal rings 26 and 27 of the well tool which sealably engage the pocket, and thus with a port in the tool leading to the pressure chamber in the tool above the piston. In the event of an abnormal condition, control fluid is exhausted from the pressure chamber to permit the plunger to retract and the flow tube to rise so that the flapper may fail closed.

As also shown and described in the aforementioned copending application, valve 10 may also be provided with means for equalizing pressure across the closed flapper 17, and thus facilitating its movement to open position. For this purpose, holes may be formed in the mandrel and passageways in the tool 16 to connect the bore above and below the closed flapper as the plunger is extended.

The subsurface safety valve for controlling flow within the space about the tubing string, and indicated in its entirety by reference character 30, is similar in many respects to the valve 10. Thus, it too comprises a mandrel 31 having upper and lower ends 32 and 33 adapted to be connected as part of the well tubing string, and intermediate cylindrical portions whose axes are offset with respect to the aligned axes of the openings through ends 32 and 33. As in the case of the upper end 12 of valve 10, upper end 32 of mandrel 31 comprises a tubular neck, which is threaded for connection to the lower end of valve 10. The neck may be connected directly to the lower tubular end 13 of the valve 10, or, alternatively, the upper and lower valves may be connected to one another, and the lower valve thus carried by the upper valve through one or more intermediate joints of tubing. The lower end 33 of the mandrel 31 is threaded (see FIG. 2C) to connect with the upper end of a lower extension 34 of the tubing string, which, in the illustrated installation, extends through a packer 35 on the lower end of the mandrel 31 to close off the space thereabout, as will be described to follow.

The mandrel 31 is also similar to mandrel 11 in that it has a bore 36 therethrough in substantial alignment with the openings in the end connections 32 and 33, and thus along an axis which is eccentric with respect to the intermediate cylindrical portions of the mandrel. This bore therefore forms a lower continuation of bore 14 through mandrel 11, and thus the tubing string to which they are connected. Similarly to mandrel 11, a pocket 37 is formed in a thickened side wall portion of the mandrel 31 and has an open upper end within the bore 36 to receive a well tool 38 which, similarly to well tool 16, may be run on a wire line through the tubing and bore.

As previously described, however, tool 38 is not for the purpose of controlling flow through the tubing, which of course is controlled by tool 16, but rather for controlling flow through a second bore 41 in mandrel 31 which is parallel to bore 36 and which is open at its upper and lower ends to the space about the tubing. Thus, a flapper 39 is pivotally mounted on the mandrel 31 by means of a pin 40 for swinging between positions opening and closing the bore 41. As in the case of flapper 17, flapper 49 is urged to closed position by spring means (to be described), and, when moved to open position, is received within a recess 42 of the mandrel to one side of bore 41.

Mandrel 31 includes upper and lower cylindrical portions 31U and 31L, the upper of which corresponds in shape and size to the upper end of the mandrel 11 of valve 10, and the lower of which is radially enlarged and eccentric with respect to the upper portion 31U. More particularly, the second bore 41 in the mandrel 31 is formed within the laterally offset portion of the lower portion 31L so that there are no obstructions to flow within the space above and below portion 31. As shown, the lower portion 31L of the mandrel is of a length no greater than required to form the bore 41 and the means (to be described) for operating flapper 39 which controls flow through it.

As will be understood from the drawings, tool 38 and the pocket 37 of the mandrel 31 in which it is received extend along an axis which is generally the center of the enlarged mandrel portion 31L, and thus intermediate the first and second bores 36 and 41, respectively, and in alignment with tool 16 and bore 15 in which it is received. More particularly, tool 38 is of generally the same construction as the tool 16, and is cooperable with flapper 39 in much the same manner as tool 16 is cooperable with flapper 17. Thus, as shown, a plunger 43 is reciprocable within tool 39 and has a lower end which extends downwardly within the mandrel above a collar 44 about a flow tube 45 reciprocable within the radially enlarged, lower portion of mandrel portion 31 to form a continuation of bore 41. Also, a piston on the upper end of plunger 43 is disposed within a pressure chamber in the tool to which control fluid may be supplied through a control line in order to lower the plunger and thus the collar 44 and flow tube 45. As the flow tube is lowered, it engages the upper end of flapper 39 to swing the flapper downwardly to its open position and hold it in such position, as shown in FIG. 1B. Still further, a spring 45A is compressed between the collar 44 and an upwardly facing shoulder in the mandrel so that, when control fluid is exhausted from the pressure chamber within the tool to permit the plunger to retract, the flow tube 45 is moved upwardly to permit the flapper 49 to move to a position closing the bore 41.

In the illustrated and preferred embodiment of the invention, control fluid is supplied to and exhausted from each of the tools 16 and 38 from a common source. For this purpose, hole 25A within mandrel 11 continues downwardly from its lateral extension into pocket 15, and a control line extension 46 is connected to the lower end of the hole for extension downwardly to connect with the upper end of a hole 46A in the thickened wall portion of mandrel 31. As shown in FIG. 1B, as well as in broken lines in FIGS. 2A and 2B, the lower end of hole 46A leads to the pocket 37 intermediate seal rings 47 and 48 carried by the tool 38 for sealably engaging the pocket, and thus with a port 38A in the tool intermediate the seal rings 47 and 48 connecting with a pressure chamber therein above the piston on the upper end of plunger 43. Although this is a preferred and illustrated embodiment of the invention, it will be understood that control fluid may be supplied to and exhausted from the pressure chambers of the tools 16 and 38 from different and independent sources, or from different and independent control lines connected to the same source.

As shown in FIGS. 2B and 2C, the interior of lower mandrel portion 31L is generally cylindrical intermediate its upper and lower ends through which the bores 36 and 41 extend, and a plate on which flapper 39 is mounted, in a manner to be descibed, is mounted within mandrel portion 31L for extension across it generally intermediate its upper and lower ends. As in the case of valve 10, a means is provided for equalizing pressure above and below the flapper 39 as plunger 43 is extended to swing the flapper to open position. For this purpose, a hole 46B extends through the flapper mounting plate to connect at its lower end with the recess 42 and its upper end with a conduit 46C leading to a hole 49 in the mandrel. As indicated diagrammatically in FIG. 2A, the upper end of hole 49 connects with the pocket 37 intermediate seal rings 47 and 50 about the tool 38, and with a port 38B in the tool intermediate the sealing engagement of seal rings 47 and 50 with pocket 37, which leads to a valve controlled passageway in the tool connecting with another port to the outside of the tool (not shown) intermediate the sealing engagement of seal rings 50 and 51 with the pocket. This latter port in the tool thus connects with port 52 in mandrel portion 31U connecting the pocket with the space outside of the mandrel, thus preventing commingling of the well fluid within the space about the tubing string with well fluid within the tubing string.

As shown in FIG. 5, and as previously described, the bore 41 is of a shape which minimizes the extent to which flow within the annulus is restricted. For this purpose, both the bore and the flapper have curved outer sides which are concentric to and as close as possible to the inner diameter of the mandrel portion 31L, as shown in FIG. 5. More particularly, the bore and flapper are essentially semi-circular or "D" shaped, with inner sides extending perpendicularly to a line extending through the axes of bore 36 and the inner diameter of the mandrel.

The inner side of the flapper has a lateral portion which receives hinge pin 40 whose opposite ends are mounted in the plate 65, and the lower side of the plate is recessed at 42A (FIG. 2B) to receive the flapper when closed. As shown in FIG. 5, spring 53 surrounding the flapper at its opposite sides are held at their opposite ends between the flapper and plate to urge the flapper closed. The flow tube 45 through which bore 41 is formed is guidably slidable within a "D" shaped opening 69 in the upper end of mandrel portion 31L and a similarly shaped opening 68 in the flapper mounting plate. In the closed position of the flapper shown in FIG. 2B, the lower end of the flow tube is above the upper side of the flapper to permit the flapper to engage a seat 71 on the lower end of the flapper plate opening 68. The upper portion 31U of the mandrel 31 of the valve 30 includes an outer housing 54 extending downwardly from the tubular end connection 32 (See FIG. 1B) at its upper end. As previously described, and as best shown in FIGS. 3 and 4, the inner diameter of the intermediate housing 54 is eccentric with respect to the axes of the openings through the end connections 12 and 13, and thus with respect to the bore 36 which forms a continuation of the end openings. This bore, as well as the pocket 37 to one side thereof for receiving tool 38, is formed within an inner body 55, which fits closely within the housing. As also shown in FIGS. 3 and 4, the hole 46A forming a lower continuation of the control line 46, as well as the upper end of the hole 49 connected to the upper end of the equalizing line 46C, are also formed in the thickened wall portion of the inner body 55, each to one side of the pocket 37 therein.

As previously mentioned, and as described in connection with the aforementioned copending application, the inner body 55 is preferably mounted in a fixed vertical position within the housing 54 by threads or other means not requiring welding. Thus, the end of the inner body 55 is held against a downwardly facing angular shoulder within the inner diameter of the housing 54, and the lower end thereof is seated against the upper end of an upper tubular extension 56 of an outer housing 57 of the lower portion 31L of the mandrel 31. More particularly, the lower end of housing 54 and the upper extension 56 of housing 57 are threadedly connected to one another so as to mount the body 55 in fixed vertical position within the outer housing 54. Seal rings 58 and 59 carried about the inner body sealably engage the inner diameter of housing 54 above and below the ports in the inner housing and the body connecting with the control line and equalizing line.

As shown in FIG. 2A, the open upper end of pocket 37 is just below the upper end of the inner body 54, so that there is considerable space above the upper end of the pocket to permit the tool to be moved into and out of the pocket as it is run on a wire line. The tool which is shown in broken lines in FIGS. 2A and 2B, is adapted to be seated on a shoulder within the pocket so as to fix it against further downward movement. Particularly, and as best shown in FIG. 2B, it is landed with its lower end just above collar 44 about the flow tube 45. As previously described, the plunger which is reciprocable within the tool has been withdrawn so that its lower end is also just above the collar 44 to permit the flow tube to be moved to its upper position by means of the coil spring 45A.

The outer housing 57 of the lower portion 31L of the mandrel 31 is, as previously mentioned, of larger diameter than the housing of the upper mandrel portion so as to dispose the bore 41 through the lower mandrel portion to one side of the upwardly extending outer housing of the upper mandrel portion. Housing 57 is made up of upper and lower parts 57A and 57B, respectively, the upper part 57A of which has the neck or upper tubular extension 56 formed thereon for connection to the lower end of the housing of the upper mandrel portion, and lower part 57B of which having the threads 33 formed about the lower end of the bore 36 for connection to the upper end of tubing extension 34.

The inner body 55 of the upper mandrel portion 31U has a lower tubular extension 60 which extends downwardly within the housing 57 and through a hole 67 in the flapper mounting plate into a counterbored portion 61 in the upper end of the portion of bore 36 formed in the lower end of housing portion 57B. A seal ring 62 is carried within the counterbored portion to seal with the tubular extension 60, and seal rings 63 are carried about the neck at the upper end of upper housing portion 57A for sealably engaging with the lower end of housing 54 of upper mandrel portion 31U beneath its threaded connection to the neck 56. Consequently, well fluids within the bore 36 forming a continuation of the tubing string are isolated from well fluids within the space about the tubing string, and thus through the bore 41.

The upper and lower housing portions 57A and 57B are threadedly connected at 64, and the flapper mounting plate 65 is seated on the upper end of housing portion 57B and held against upward movement by means of a split ring 66 removably disposed within a groove about the inner diameter of upper housing portion 57A. Coil spring 45A is received within the inner diameter of upper housing portion 57A with its lower end resting on the snap ring 66, and its upper end engaging the lower side of collar 44 so as to urge the upper side of the collar against a downwardly facing shoulder 69A at the lower side of the upper end of housing portion 57A.

The flapper mounting plate 65 is sealed with respect to the housing 57 by means of a seal ring 70 thereabout, and seal ring 71 is carried about the hole 68 in the plate to form a sliding seal about the lower body extension 60. Thus, with tool 38 landed within the pocket, well fluids within the tubing and space about the tubing are prevented from commingling. As shown in FIG. 2B, seat 71 includes an inner "D" shaped metal ring surrounded by a rubber sealing element of similar shape whose lower end is adapted to be sealably engaged by the face of the flapper 39 as the flapper swings upwardly to closed position, as shown in FIG. 2B. Thus, well fluids within the space about the tubing are confined for flow through the bore 41 with the flow tube.

As shown in FIG. 2C, a tubular member 72 is threadedly connected at 73 to the outer diameter of the lower end of housing portion 57B of the mandrel 31, and a latch assembly 74 is carried on the lower end of the tubular member 72 for releasably connecting the member 72 and thus the mandrels thereof as well as the tubing string from which they are suspended to the upper inner diameter of the body 35 of the packer. As shown diagrammatically in FIG. 2C, the packer includes an annular sealing element 75 thereabout so that well fluid within the well bore therebelow and about the tubing is confined for flow upwardly into the bore 41 formed in the valve 30 whereby it is controlled in the manner previously described by means of the flapper 39.

As previously described, tool 38 is of much the same construction as the tool 16, and thus reference may be had to the aforementioned copending application, for details of its construction and operation. It differs in that the upper end of the equalizing hole does not connect with the inside of the tubing string, but rather is diverted through the port 52 to the space about the tubing string. This, of course, prevents commingling of the well fluids within the space with those within the tubing string.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in controlling flow within a well bore, comprising a mandrel having a first bore therethrough adapted to be connected as part of a well tubing string, whereby it may be lowered with the string into the well bore, and a second bore therethrough parallel to the first bore for connection at its upper and lower ends with the space within the well bore about the tubing string, a closure member mounted on the mandrel for movement between positions opening and closing the second bore, means yieldably urging said closure member to closed position, said mandrel having a pocket therein to one side of the first bore and having one end opening to the first bore, a tool adapted to be run on a wire line through said tubing string and first bore into and out of the pocket, and means including fluid responsive means within said tool for moving the closure member from closed to open position.

2. Apparatus of the character defined in claim 1, including means through which control fluid from a source at the head of the well may be supplied to the fluid responsive means of said tool in order to move the closure member to open position and exhausted therefrom to permit the closure member to close.

3. Apparatus of the character defined in claim 1, wherein the closure member is a flapper pivotally mounted on the mandrel for swinging between opened and closed positions, and the outer side of the second bore and outer edge of the flapper are curved generally concentrically of the outer cylindrical surface of the portion of the mandrel in which said second bore is formed.

4. Apparatus of the character defined in claim 3, wherein the inner side of the second bore and inner edge of the flapper are generally flat, and the flapper is swingably mounted along an axis extending between the inner generally flat side of the second bore and the first bore.

5. Apparatus of the character defined in claim 3, wherein a flow tube having a cross-sectional shape fitting closely within the second bore is mounted for reciprocation therein, and the tool includes means which is responsive to said fluid responsive means for moving the tube in a direction to swing the flapper to open position.

6. Apparatus for use in controlling flow within a well bore, comprising body means having a first bore therethrough adapted to be connected as part of a well tubing string, whereby it may be lowered within the string into the well bore, and a second bore therethrough parallel to the first bore for connection at its upper and lower ends with the space within the well bore about the tubing string, a first closure member mounted on the body means for movement between positions opening and closing the first bore, a second closure member mounted on the body means for movement between positions opening and closing the second bore, means yieldably urging each of said closure members to closed position, said body means having first and second pockets therein to one side of the first bore and each having one end opening to the first bore, a first tool adapted to be run on a wire line through the tubing string and first bore into and out of the first pocket, a second tool adapted to be run on a wire line through the tubing string and first bore into and out of the second pocket, means including fluid responsive means within the first tool for moving the first closure member from closed to open position, and means including fluid responsive means within the second tool for moving the second closure member from closed to open position.

7. Apparatus of the character defined in claim 6, wherein the body means comprises a pair of mandrels adapted to be connected one above the other, one mandrel having one end of the first bore and the first pocket formed therein and the first closure member mounted thereon for opening and closing such one end of the first bore, and the other mandrel having the other end of the first bore, the second pocket, and the second bore formed therein and the second closure member mounted thereon for opening and closing the second bore.

8. Apparatus of the character defined in claim 6, including means through which control fluid from a source at the head of the well may be supplied to the fluid responsive means of said tool in order to move the closure member to open position and exhausted therefrom to permit the closure member to close.

9. Apparatus of the character defined in claim 6, wherein the second closure member is a flapper pivotally mounted on the body means for swinging between opened and closed positions, and the outer side of the second bore and outer edge of the flapper are curved generally concentrically of the outer cylindrical surface of the portion of the body means in which said second bore is formed.

10. Apparatus of the character defined in claim 9, wherein a flow tube having a cross-sectional shape fitting closely within the second bore is mounted for reciprocation within the second bore, and the second tool includes means which is responsive to said fluid responsive means for moving the tube in a direction to swing the flapper to open position.

11. Apparatus for use in controlling flow within a well bore, comprising a mandrel having a first bore therethrough adapted to be connected as part of a well tubing string, whereby it may be lowered with the string into the well bore, and a second bore therethrough parallel to the first bore for connection at its upper and lower ends with the space within the well bore about the tubing string, a closure member mounted on the mandrel for movement between positions opening and closing the second bore, said mandrel having a pocket therein to one side of the first bore and having one end opening to the first bore, a tool adapted to be run on a wire line through said tubing string and first bore into and out of the pocket, and means including fluid responsive means within said tool for moving the closure member between said positions.

12. Apparatus of the character defined in claim 11, wherein the closure member is a flapper pivotally mounted on the mandrel for swinging between opened and closed positions, and the outer side of the second bore and outer edge of the flapper are curved generally concentrically of the outer cylindrical surface of the portion of the mandrel in which said second bore is formed.

13. Apparatus of the character defined in claim 12, wherein the inner side of the second bore and inner edge of the flapper are generally flat, and the flapper is swingably mounted along an axis extending between the inner generally flat side of the second bore and the first bore.

14. Apparatus for use in controlling flow within a well bore, comprising body means having a first bore therethrough adapted to be connected as part of a well tubing string, whereby it may be lowered within the string into the well bore, and a second bore therethrough parallel to the first bore for connection at its upper and lower ends with the space within the well bore about the tubing string, a first closure member mounted on the body means for movement between positions opening and closing the first bore, a second closure member mounted on the body means for movement between positions opening and closing the second bore, said body means having first and second pockets therein to one side of the first bore and each having one end opening to the first bore, a first tool adapted to be run on a wire line through the tubing string and first bore into and out of the first pocket, a second tool adapted to be run on a wire line through the tubing string and first bore into and out of the second pocket, means including fluid responsive means within the first tool for moving the first closure member between said positions, and means including fluid responsive means within the second tool for moving the second closure member between said positions.

15. Apparatus of the character defined in claim 14, wherein the body means comprises a pair of mandrels adapted to be connected one above the other, one mandrel having one end of the first bore and the first pocket formed therein and the first closure member mounted thereon for opening and closing such one end of the first bore, and the other mandrel having the other end of the first bore, the second pocket, and the second bore formed therein and the second closure member mounted thereon for opening and closing the second bore.

16. Apparatus of the character defined in claim 14, wherein the closure member is a flapper pivotally mounted on the body means for swinging between opened and closed positions, and the outer side of the second bore and outer edge of the flapper are curved generally concentrically of the outer cylindrical surface of the portion of the body means in which said second bore is formed.

17. Apparatus for use in controlling flow within a well bore, comprising a mandrel having a first bore therethrough adapted to be connected as part of a well tubing string, whereby it may be lowered with the string into the well bore, and a second bore therethrough parallel to the first bore for connection at its upper and lower ends with the space within the well bore about the tubing string, and a closure member mounted on the mandrel for movement between positions opening and closing the second bore, said mandrel having a pocket therein to one side of the first bore and having one end opening to the first bore so that a tool may be run on a wire line through said tubing string and first bore into and out of a landed position within the pocket, and said closure member being movable to one of its positions by means on said tool when so landed.

18. Apparatus of the character defined in claim 17, wherein the closure member is a flapper pivotally mounted on the mandrel for swinging between opened and closed positions, and the outer side of the second bore and outer edge of the flapper are curved generally concentrically of the outer cylindrical surface of the portion of the mandrel in which said second bore is formed.

19. Apparatus of the character defined in claim 18, wherein the inner side of the second bore and inner edge of the flapper are generally flat, and the flapper is swingably mounted along an axis extending between the inner generally flat side of the second bore and the first bore.

20. Apparatus for use in controlling flow within a well bore, comprising body means having a first bore therethrough adapted to be connected as part of a well tubing string, whereby it may be lowered within the string into the well bore, and a second bore therethrough parallel to the first bore for connection at its upper and lower ends with the space within the well bore about the tubing string, a first closure member mounted on the body means for movement between positions opening and closing the first bore, and a second closure member mounted on the body means for movement between positions opening and closing the second bore, said body means having first and second pockets therein to one side of the first bore and each having one end opening to the first bore so that the first and second tools may be run on wire lines through the tubing string and first bore into and out of landed positions within the first and second pockets, respectively, and each of said first and second closure means being movable to one of its positions by means on said first and second tools, respectively, when so landed.

21. Apparatus of the character defined in claim 20, wherein the body means comprises a pair of mandrels adapted to be connected one above the other, one mandrel having one end of the first bore and the first pocket formed therein and the first closure member mounted thereon for opening and closing such one end of the first bore, and the other mandrel having the other end of the first bore, the second pocket, and the second bore formed therein and the second closure member mounted thereon for opening and closing the second bore.

22. Apparatus of the character defined in claim 20, wherein the closure member is a flapper pivotally mounted on the body means for swinging between opened and closed positions, and the outer side of the second bore and outer edge of the flapper are curved generally concentrically of the outer cylindrical surface of the portion of the body means in which said second bore is formed.

23. Apparatus for use in controlling flow within a well bore, comprising a mandrel having a first bore therethrough adapted to be connected as part of a well tubing string, whereby it may be lowered with the string into the well bore, and a second bore therethrough parallel to the first bore for connection at its upper and lower ends with the space within the well bore about the tubing string, and a flapper mounted on the mandrel for swinging between positions opening and closing the second bore, the outer side of the second bore and outer edge of the flapper being curved generally concentrically of an outer cylindrical surface of the portion of the body means in which said second bore is formed.

24. Apparatus of the character defined in claim 23, wherein the inner side of the second bore and inner edge of the flapper are generally flat, and the flapper is swingably mounted along an axis extending between the inner generally flat side of the second bore and the first bore.

25. Apparatus for use in controlling flow within a well bore, comprising body means having a first bore therethrough adapted to be connected as part of a well tubing string, whereby it may be lowered within the string into the well bore, and a second bore therethrough parallel to the first bore for connection at its upper and lower ends with the space within the well bore about the tubing string, a first closure member mounted on the body means for movement between positions opening and closing the first bore, a flapper mounted on the body means for swinging between positions opening and closing the second bore, and the outer side of the second bore and outer edge of the flapper being curved generally concentrically of the outer cylindrical surface of the portion of the body means in which said second bore is formed.

* * * * *